US008739886B2

(12) United States Patent
Fripp et al.

(10) Patent No.: US 8,739,886 B2
(45) **Date of Patent: *Jun. 3, 2014**

(54) DOWNHOLE FLUID FLOW CONTROL SYSTEM HAVING A FLUIDIC MODULE WITH A BRIDGE NETWORK AND METHOD FOR USE OF SAME

(71) Applicant: Halliburton Energy Services, Inc., Houston, TX (US)

(72) Inventors: Michael Linley Fripp, Carrollton, TX (US); Jason D. Dykstra, Carrollton, TX (US); John Charles Gano, Carrollton, TX (US); Luke William Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/792,515

(22) Filed: Mar. 11, 2013

(65) Prior Publication Data

US 2013/0186634 A1 Jul. 25, 2013

Related U.S. Application Data

(63) Continuation of application No. 13/217,738, filed on Aug. 25, 2011, now Pat. No. 8,584,762.

(51) Int. Cl.
*E21B 34/08* (2006.01)

(52) U.S. Cl.
USPC ..... 166/373; 166/374; 166/381; 166/319

(58) Field of Classification Search
USPC ..... 166/373, 374, 381, 316, 319
See application file for complete search history.

(56) References Cited

U.S. PATENT DOCUMENTS

| | | | |
|---|---|---|---|
| 3,566,900 | A | 3/1971 | Black |
| 3,620,238 | A | 11/1971 | Kawabata |
| 3,712,321 | A | 1/1973 | Bauer |
| 4,276,943 | A | 7/1981 | Holmes |
| 4,364,232 | A | 12/1982 | Sheinbaum |
| 4,557,295 | A | 12/1985 | Holmes |

(Continued)

FOREIGN PATENT DOCUMENTS

| | | |
|---|---|---|
| WO | 2010053378 | 5/2010 |
| WO | 2010087719 | 8/2010 |

(Continued)

OTHER PUBLICATIONS

Stanley W. Angrist, "Fluid Control Devices." Scientific American, Dec. 1964: pp. 80-88.

(Continued)

*Primary Examiner* — Jennifer H Gay
*Assistant Examiner* — Elizabeth Gitlin
(74) *Attorney, Agent, or Firm* — Lawrence R. Youst

(57) ABSTRACT

A downhole fluid flow control system includes a fluidic module (150) having a bridge network. The bridge network has first and second branch fluid pathways (163, 164) each including at least one fluid flow resistors (174, 180) and a pressure output terminal (178, 184). In operation, the pressure difference between the pressure output terminals (178, 184) of the first and second branch fluid pathways (163, 164) is operable to control fluid flow through the fluidic module (150).

30 Claims, 6 Drawing Sheets

(56) References Cited

U.S. PATENT DOCUMENTS

| | | | |
|---|---|---|---|
| 4,648,455 | A | 3/1987 | Luke |
| 4,895,582 | A | 1/1990 | Bielefeldt |
| 5,076,327 | A | 12/1991 | Mettner |
| 5,338,496 | A | 8/1994 | Talbot et al. |
| 5,707,214 | A | 1/1998 | Schmidt |
| 6,497,252 | B1 | 12/2002 | Kohler et al. |
| 6,708,763 | B2 | 3/2004 | Howard et al. |
| 6,769,498 | B2 | 8/2004 | Hughes |
| 7,350,577 | B2 | 4/2008 | Howard et al. |
| 7,464,609 | B2 | 12/2008 | Fallet |
| 2003/0173086 | A1 | 9/2003 | Howard et al. |
| 2004/0011561 | A1 | 1/2004 | Hughes |
| 2005/0150657 | A1 | 7/2005 | Howard et al. |
| 2006/0131033 | A1 | 6/2006 | Bode et al. |
| 2007/0193752 | A1 | 8/2007 | Kim |
| 2008/0149323 | A1 | 6/2008 | O'Malley et al. |
| 2008/0314578 | A1 | 12/2008 | Jackson |
| 2009/0133869 | A1 | 5/2009 | Clem |
| 2011/0042091 | A1 | 2/2011 | Dykstra |
| 2011/0198097 | A1 * | 8/2011 | Moen ..... 166/373 |

FOREIGN PATENT DOCUMENTS

| | | |
|---|---|---|
| WO | 2011041674 | 4/2011 |
| WO | 2011095512 | 8/2011 |
| WO | 2011115494 | 9/2011 |

OTHER PUBLICATIONS

Rune Freyer, et al. "An Oil Selective Inflow Control System." SPE 78272, Oct. 29-31, 2002. pp. 1-8.

"Lee Restrictor Selector" The Lee Company, (Undated but admitted prior art).

International Search Report and Written Opinion, KIPO, PCT/US2012/049671, Feb. 20, 2013.

* cited by examiner

DOWNHOLE FLUID FLOW CONTROL SYSTEM HAVING A FLUIDIC MODULE WITH A BRIDGE NETWORK AND METHOD FOR USE OF SAME

CROSS-REFERENCE TO RELATED APPLICATIONS

This patent application is a continuation of U.S. patent application Ser. No. 13/217,738 filed Aug. 25, 2011. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole fluid flow control system and method that are operable to control the inflow of formation fluids and the outflow of injection fluids with a fluidic module having a bridge network.

BACKGROUND OF THE INVENTION

Without limiting the scope of the present invention, its background will be described with reference to producing fluid from a hydrocarbon bearing subterranean formation, as an example. During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screen assemblies positioned proximate the desired production interval or intervals. In other completions, to control the flowrate of production fluids into the production tubing, it is common practice to install one or more flow control devices within the tubing string.

Attempts have been made to utilize fluid flow control devices within completions requiring sand control. For example, in certain sand control screen assemblies, after production fluids flow through the filter medium, the fluids are directed into a flow control section. The flow control section may include one or more flow control components such as flow tubes, nozzles, labyrinths or the like. Typically, the production flowrate through these flow control screens is fixed prior to installation by the number and design of the flow control components.

It has been found, however, that due to changes in formation pressure and changes in formation fluid composition over the life of the well, it may be desirable to adjust the flow control characteristics of the flow control sections. In addition, for certain completions, such as long horizontal completions having numerous production intervals, it may be desirable to independently control the inflow of production fluids into each of the production intervals. Further, in some completions, it would be desirable to adjust the flow control characteristics of the flow control sections without the requirement for well intervention.

Accordingly, a need has arisen for a flow control screen that is operable to control the inflow of formation fluids in a completion requiring sand control. A need has also arisen for flow control screens that are operable to independently control the inflow of production fluids from multiple production intervals. Further, a need has arisen for such flow control screens that are operable to control the inflow of production fluids without the requirement for well intervention as the composition of the fluids produced into specific intervals changes over time.

SUMMARY OF THE INVENTION

The present invention disclosed herein comprises a downhole fluid flow control system for controlling fluid production in completions requiring sand control. In addition, the downhole fluid flow control system of the present invention is operable to independently control the inflow of production fluids into multiple production intervals without the requirement for well intervention as the composition of the fluids produced into specific intervals changes over time.

In one aspect, the present invention is directed to a downhole fluid flow control system. The downhole fluid flow control system includes a fluidic module having a bridge network with first and second branch fluid pathways each including at least one fluid flow resistor and a pressure output terminal. The pressure difference between the pressure output terminals of the first and second branch fluid pathways is operable to control fluid flow through the fluidic module.

In one embodiment, the first and second branch fluid pathways each include at least two fluid flow resistors. In this embodiment, the pressure output terminals of each branch fluid pathway may be positioned between the two fluid flow resistors. Also, in this embodiment, the two fluid flow resistors of each branch fluid pathway may have different responses to a fluid property such as fluid viscosity, fluid density, fluid composition or the like. In certain embodiments, the first and second branch fluid pathways may each have a common fluid inlet and a common fluid outlet with a main fluid pathway. In such embodiments, the fluid flowrate ratio between the main fluid pathway and the branch fluid pathways may be between about 5 to 1 and about 20 to 1 and is preferably greater than 10 to 1.

In one embodiment, the fluidic module may include a valve having first and second positions. In the first position, the valve is operable to allow fluid flow through the main fluid pathway. In the second position, the valve is operable to prevent fluid flow through the main fluid pathway. In this embodiment, the pressure difference between the pressure output terminals of the first and second branch fluid pathways is operable to shift the valve between the first and second positions. In some embodiments, the fluidic module may have an injection mode wherein the pressure difference between the pressure output terminals of the first and second branch fluid pathways created by an outflow of injection fluid shifts the valve to open the main fluid pathway and a production mode wherein the pressure difference between the pressure output terminals of the first and second branch fluid pathways created by an inflow of production fluid shifts the valve to close the main fluid pathway.

In other embodiments, the fluidic module may have a first production mode wherein the pressure difference between the pressure output terminals of the first and second branch fluid pathways created by an inflow of a desired fluid shifts the valve to open the main fluid pathway and a second production mode wherein the pressure difference between the pressure output terminals of the first and second branch fluid pathways created by an inflow of an undesired fluid shifts the valve to close the main fluid pathway. In any of these embodiments, the fluid flow resistors may be selected from the group consisting of nozzles, vortex chambers, flow tubes, fluid selectors and matrix chambers.

In another aspect, the present invention is directed to a flow control screen. The flow control screen includes a base pipe with an internal passageway, a blank pipe section and a perforated section. A filter medium is positioned around the blank pipe section of the base pipe. A housing is positioned around the base pipe defining a fluid flow path between the filter medium and the internal passageway. At least one fluidic module is disposed within the fluid flow path. The fluidic module has a bridge network with first and second branch fluid pathways each including at least one fluid flow resistor and a pressure output terminal such that a pressure difference between the pressure output terminals of the first and second branch fluid pathways is operable to control fluid flow through the fluidic module.

In a further aspect, the present invention is directed to a downhole fluid flow control system. The downhole fluid flow control system includes a fluidic module having a main fluid pathway, a valve and a bridge network. The valve has a first position wherein fluid flow through the main fluid pathway is allowed and a second position wherein fluid flow through the main fluid pathway is restricted. The bridge network has first and second branch fluid pathways each have a common fluid inlet and a common fluid outlet with the main fluid pathway and each including two fluid flow resistors with a pressure output terminal positioned therebetween. A pressure difference between the pressure output terminals of the first and second branch fluid pathways is operable to shift the valve between the first and second positions.

In yet another aspect, the present invention is directed to a downhole fluid flow control method. The method includes positioning a fluid flow control system at a target location downhole, the fluid flow control system including a fluidic module having a main fluid pathway, a valve and a bridge network with first and second branch fluid pathways each having a common fluid inlet and a common fluid outlet with the main fluid pathway and each including two fluid flow resistors with a pressure output terminal positioned therebetween; producing a desired fluid through the fluidic module; generating a first pressure difference between the pressure output terminals of the first and second branch fluid pathways that biases the valve toward a first position wherein fluid flow through the main fluid pathway is allowed; producing an undesired fluid through the fluidic module; and generating a second pressure difference between the pressure output terminals of the first and second branch fluid pathways that shifts the valve from the first position to a second position wherein fluid flow through the main fluid pathway is restricted.

The method may also include biasing the valve toward the first position responsive to producing a formation fluid containing at least a predetermined amount of the desired fluid, shifting the valve from the first position to the second position responsive to producing a formation fluid containing at least a predetermined amount of the undesired fluid or sending a signal to the surface indicating the valve has shifted from the first position to the second position.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
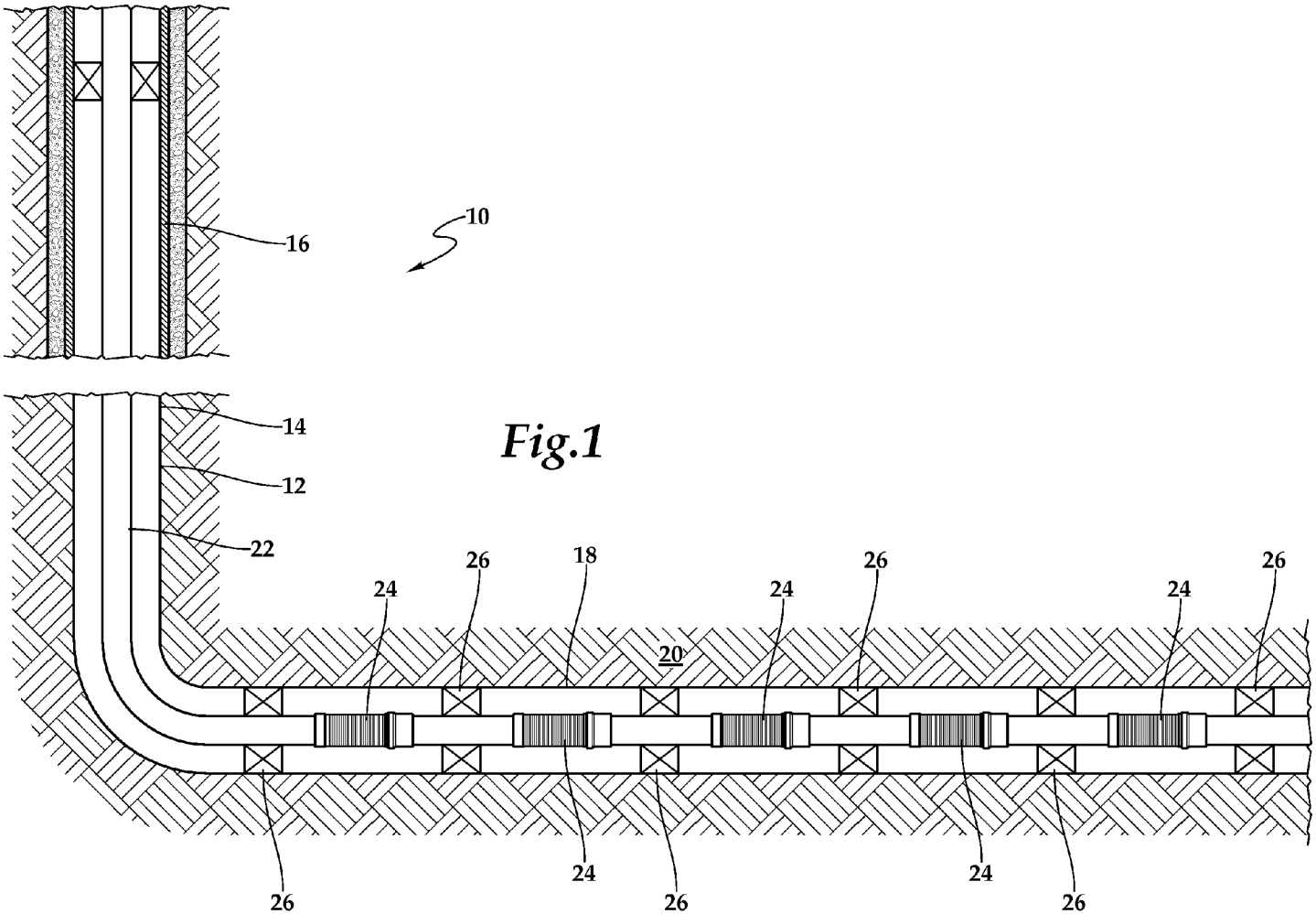
FIG. 1 is a schematic illustration of a well system operating a plurality of flow control screens according to an embodiment of the present invention.

Referring initially to FIG. 1, therein is depicted a well system including a plurality of downhole fluid flow control systems positioned in flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of annular barriers depicted as packers 26 that provides a fluid seal between the completion string and wellbore 12, thereby defining the production intervals. In the illustrated embodiment, flow control screens 24 serve the function of filtering particulate matter out of the production fluid stream. Each flow control screens 24 also has a flow control section that is operable to control fluid flow therethrough.

For example, the flow control sections may be operable to control flow of a production fluid stream during the production phase of well operations. Alternatively or additionally, the flow control sections may be operable to control the flow of an injection fluid stream during a treatment phase of well operations. As explained in greater detail below, the flow control sections preferably control the inflow of production fluids over the life of the well into each production interval without the requirement for well intervention as the composition of the fluids produced into specific intervals changes over time in order to maximize production of a desired fluid such as oil and minimize production of an undesired fluid such as water or gas.

Even though FIG. 1 depicts the flow control screens of the present invention in an open hole environment, it should be understood by those skilled in the art that the present invention is equally well suited for use in cased wells. Also, even though FIG. 1 depicts one flow control screen in each production interval, it should be understood by those skilled in the art that any number of flow control screens of the present invention may be deployed within a production interval without departing from the principles of the present invention. In addition, even though FIG. 1 depicts the flow control screens of the present invention in a horizontal section of the wellbore, it should be understood by those skilled in the art that the present invention is equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Further, even though FIG. 1 depicts the flow control components associated with flow control screens in a tubular string, it should be understood by those skilled in the art that the flow control components of the present invention need not be associated with a flow control screen or be deployed as part of the tubular string. For example, one or more flow control components may be deployed and removably inserted into the center of the tubing string or side pockets of the tubing string.

Figure 2A:
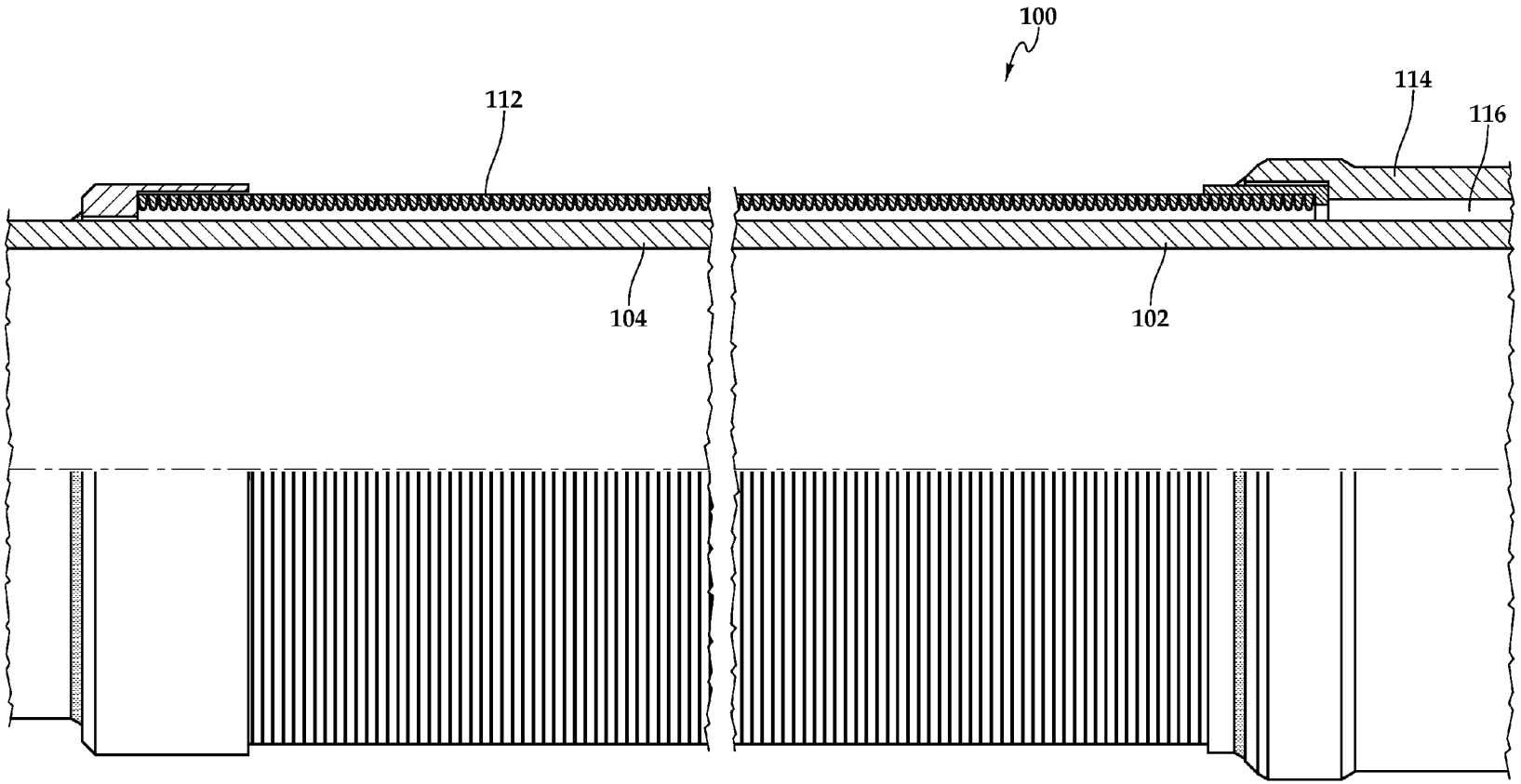
FIGS. 2A-2B are quarter sectional views of successive axial sections of a downhole fluid flow control system embodied in a flow control screen according to an embodiment of the present invention.
Figure 2B:
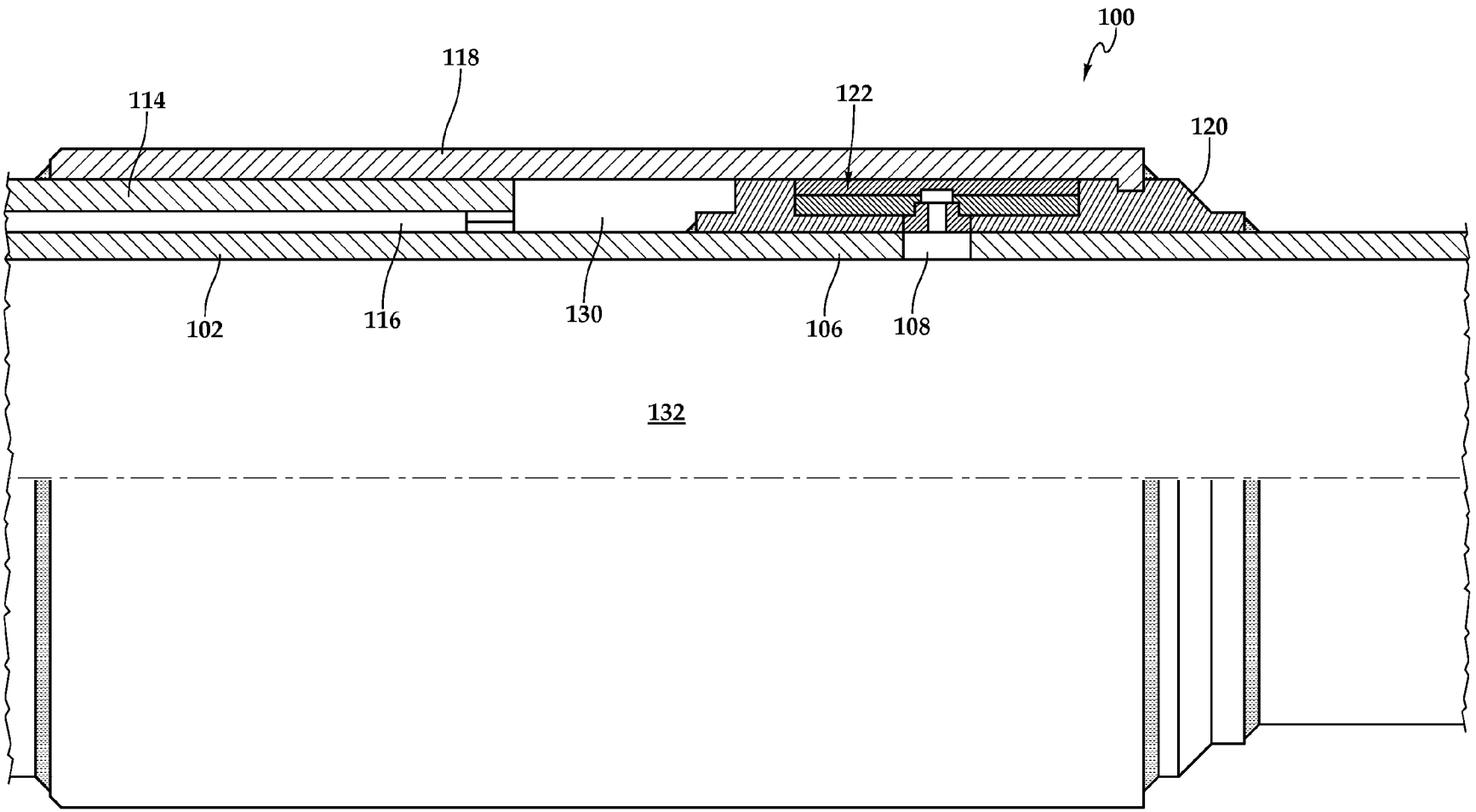

Referring next to FIGS. 2A-2B, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108. Positioned around an uphole portion of blank pipe section 104 is a screen element or filter medium 112, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the present invention does not need to have a filter medium associated therewith, accordingly, the exact design of the filter medium is not critical to the present invention.

Positioned downhole of filter medium 112 is a screen interface housing 114 that forms an annulus 116 with base pipe 102. Securably connected to the downhole end of screen interface housing 114 is a flow control housing 118. At its downhole end, flow control housing 118 is securably connected to a support assembly 120 which is securably coupled to base pipe 102. The various connections of the components of flow control screen 100 may be made in any suitable fashion including welding, threading and the like as well as through the use of fasteners such as pins, set screws and the like. Positioned between support assembly 120 and flow control housing 118 are a plurality of fluidic modules 122, only one of which is visible in FIG. 2B. In the illustrated embodiment, fluidic modules 122 are circumferentially distributed about base pipe 102 at one hundred and twenty degree intervals such that three fluidic modules 122 are provided. Even though a particular arrangement of fluidic modules 122 has been described, it should be understood by those skilled in the art that other numbers and arrangements of fluidic modules 122 may be used. For example, either a greater or lesser number of circumferentially distributed flow control components at uniform or nonuniform intervals may be used. Additionally or alternatively, fluidic modules 122 may be longitudinally distributed along base pipe 102.

As discussed in greater detail below, fluidic modules 122 may be operable to control the flow of fluid in either direction therethrough. For example, during the production phase of well operations, fluid flows from the formation into the production tubing through fluid flow control screen 100. The production fluid, after being filtered by filter medium 112, if present, flows into annulus 116. The fluid then travels into an annular region 130 between base pipe 102 and flow control housing 118 before entering the flow control section as further described below. The fluid then enters one or more inlets of fluidic modules 122 where the desired flow operation occurs depending upon the composition of the produced fluid. For example, if a desired fluid is produced, flow through fluidic modules 122 is allowed. If an undesired fluid is produced, flow through fluidic modules 122 is restricted or substantially prevented. In the case of producing a desired fluid, the fluid is discharged through opening 108 to interior flow path 132 of base pipe 102 for production to the surface.

As another example, during the treatment phase of well operations, a treatment fluid may be pumped downhole from the surface in interior flow path 132 of base pipe 102. As it is typically desirable to inject the treatment fluid at a much higher flowrate than the expected production flowrate, the present invention enables interventionless opening of injection pathways which will subsequently close interventionless upon commencement of production. In this case, the treatment fluid enters the fluidic modules 122 through openings 108 where the desired flow operation occurs and the injection pathways are opened. The fluid then travels into annular region 130 between base pipe 102 and flow control housing 118 before entering annulus 116 and passing through filter medium 112 for injection into the surrounding formation. When production begins, and fluid enters fluidic modules 122 from annular region 130, the desired flow operation occurs and the injection pathways are closed. In certain embodiments, fluidic modules 122 may be used to bypass filter medium 112 entirely during injection operations.

Figure 3:
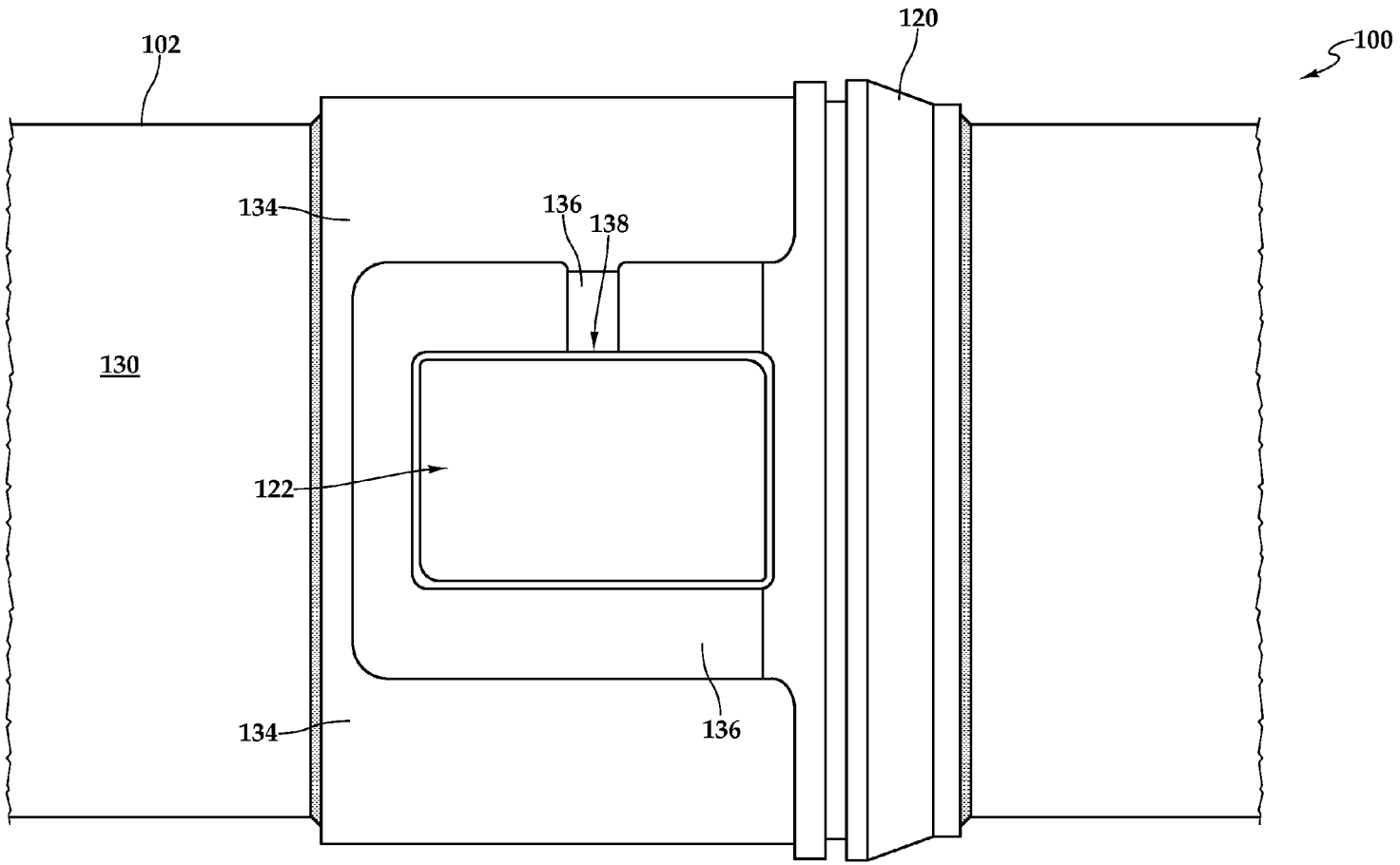
FIG. 3 is a top view of the flow control section of a flow control screen with the outer housing removed according to an embodiment of the present invention.

Referring next to FIG. 3, a flow control section of flow control screen 100 is representatively illustrated. In the illustrated section, support assembly 120 is securably coupled to base pipe 102. Support assembly 120 is operable to receive and support three fluidic modules 122. The illustrated fluidic modules 122 may be formed from any number of components and may include a variety of fluid flow resistors as described in greater detail below. Support assembly 120 is positioned about base pipe 102 such that fluid discharged from fluidic modules 122 during production will be circumferentially and longitudinally aligned with the openings 108 (see FIG. 2B) of base pipe 102. Support assembly 120 includes a plurality of channels for directing fluid flow between fluidic modules 122 and annular region 130. Specifically, support assembly 120 includes a plurality of longitudinal channels 134 and a plurality of circumferential channels 136. Together, longitudinal channels 134 and circumferential channels 136 provide a pathway for fluid flow between openings 138 of fluidic modules 122 and annular region 130.

Figure 4A:
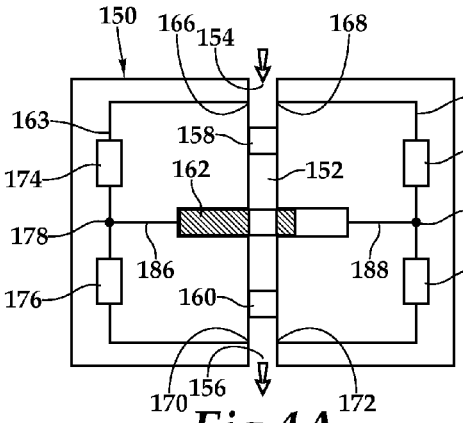
FIGS. 4A-B are schematic illustrations of a fluidic module according to an embodiment of the present invention in first and second operating configurations.
Figure 4B:
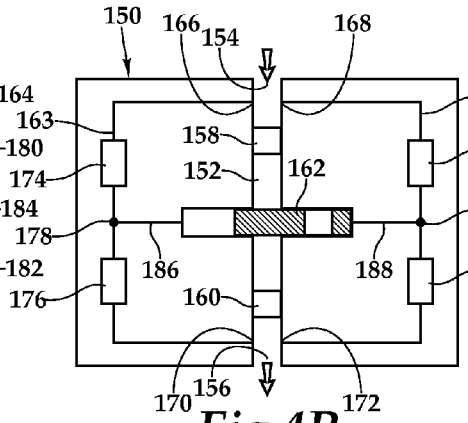

Referring next to FIGS. 4A-4B, therein is depicted a schematic illustration of a fluidic module of the present invention in its open and closed operating positions that is generally designated 150. Fluidic module 150 includes a main fluid pathway 152 having an inlet 154 and an outlet 156. Main fluid pathway 152 provides the primary flow path for fluid transfer through fluidic module 150. In the illustrated embodiment, a pair of fluid flow resistors 158, 160 are positioned within main fluid pathway 152. Fluid flow resistors 158, 160 may be of any suitable type, such as those described below, and are used to create a desired pressure drop in the fluid passing through main fluid pathway 152, which assures proper operation of fluidic module 150.

A valve 162 is positioned relative to main fluid pathway 152 such that valve 162 has a first position wherein fluid flow through main fluid pathway 152 is allowed, as best seen in FIG. 4A, and a second position wherein fluid flow through main fluid pathway 152 is prevented, as best seen in FIG. 4B. In the illustrated embodiment, valve 162 is a pressure operated shuttle valve. Even though valve 162 is depicted as a shuttle valve, those skilled in the art will understand that other types of pressure operated valves could alternatively be used in a fluidic module of the present invention including sliding sleeves, ball valves, flapper valves or the like. Also, even though valve 162 is depicted as having two positions; namely opened and closed positions, those skilled in the art will understand that valves operating in a fluidic module of the present invention could alternatively have two opened positions with different levels of fluid choking or more than two positions such as an open position, one or more choking positions and a closed position.

Fluidic module 150 includes a bridge network having two branch fluid pathways 163, 164. In the illustrated embodiment, branch fluid pathway 163 has an inlet 166 from main fluid pathway 152. Likewise, branch fluid pathway 164 has an inlet 168 from main fluid pathway 152. Branch fluid pathway 163 has an outlet 170 into main fluid pathway 152. Similarly, branch fluid pathway 164 has an outlet 172 into main fluid pathway 152. As depicted, branch fluid pathways 163, 164 are in fluid communication with main fluid pathway 152, however, those skilled in the art will recognize that branch fluid pathways 163, 164 could alternatively be tapped along a fluid pathway other than main fluid pathway 152 or be tapped directly to one or more inlets and outlets of fluidic module 150. In any such configurations, branch fluid pathways 163, 164 will be considered to have common fluid inlets and common fluid outlets with the main fluid pathway so long as branch fluid pathways 163, 164 and main fluid pathway 152 directly or indirectly share the same pressure sources, such as wellbore pressure and tubing pressure, or are otherwise fluidically connected. It should be noted that the fluid flowrate through main fluid pathway 152 is typically much greater than the flowrate through branch fluid pathways 163, 164. For example, the ratio in the fluid flowrate between main fluid pathway 152 and branch fluid pathways 163, 164 may be between about 5 to 1 and about 20 to 1 and is preferably greater than 10 to 1.

Branch fluid pathway 163 has two fluid flow resistors 174, 176 positioned in series with a pressure output terminal 178 positioned therebetween. Likewise, branch fluid pathway 164 has two fluid flow resistors 180, 182 positioned in series with a pressure output terminal 184 positioned therebetween. Pressure from pressure output terminal 178 is routed to valve 162 via fluid pathway 186. Pressure from pressure output terminal 184 is routed to valve 162 via fluid pathway 188. As such, if the pressure at pressure output terminal 184 is higher than the pressure at pressure output terminal 178, valve 162 is biased to the open position, as best seen in FIG. 4A. Alternatively, if the pressure at pressure output terminal 178 is higher than the pressure at pressure output terminal 184, valve 162 is biased to the closed position, as best seen in FIG. 4B.

The pressure difference between pressure output terminals 178, 184 is created due to differences in flow resistance and associated pressure drops in the various fluid flow resistors 174, 176, 180, 182. As shown, the bridge network can be described as two parallel branches each having two fluid flow resistors in series with a pressure output terminal therebetween. This configuration simulates the common Wheatstone bridge circuit. With this configuration, fluid flow resistors 174, 176, 180, 182 can be selected such that the flow of a desired fluid such as oil through fluidic module 150 generates a differential pressure between pressure output terminals 178, 184 that biases valve 162 to the open position and the flow of an undesired fluid such as water or gas through fluidic module 150 generates a differential pressure between pressure output terminals 178, 184 that biases valve 162 to the closed position.

Figure 7A:
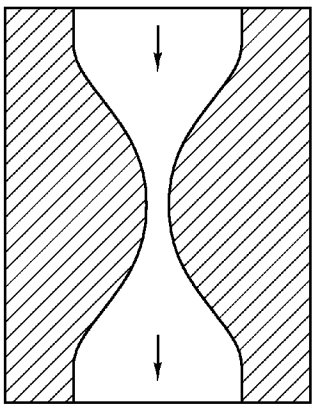
FIGS. 7A-F are schematic illustrations of fluid flow resistors for use in a fluidic module according to various embodiments of the present invention.
Figure 7B:
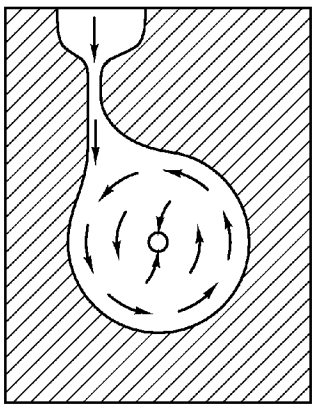

For example, fluid flow resistors 174, 176, 180, 182 can be selected such that their flow resistance will change or be dependent upon a property of the fluid flowing therethrough such as fluid viscosity, fluid density, fluid composition, fluid velocity, fluid pressure or the like. In the example discussed above wherein oil is the desired fluid and water or gas is the undesired fluid, fluid flow resistors 174, 182 may be nozzles, such as that depicted in FIG. 7A, and fluid flow resistors 176, 178 may be vortex chambers, such as that depicted in FIG. 7B. In this configuration, when the desired fluid, oil, flows through branch fluid pathway 163, it experience a greater pressure drop in fluid flow resistor 174, a nozzle, than in fluid flow resistor 176, a vortex chamber. Likewise, as the desired fluid flows through branch fluid pathway 164, it experiences a lower pressure drop in fluid flow resistor 180, a vortex chamber, than in fluid flow resistor 182, a nozzle. As the total pressure drop across each branch fluid pathway 163, 164 must be the same due to the common fluid inlets and common fluid outlets, the pressure at pressure output terminals 178, 184 is different. In this case, the pressure at pressure output terminal 178 is less than the pressure at pressure output terminal 184, thus biasing valve 162 to the open position shown in FIG. 4A.

Also, in this configuration, when the undesired fluid, water or gas, flows through branch fluid pathway 163, it experiences a lower pressure drop in fluid flow resistor 174, a nozzle, than in fluid flow resistor 176, a vortex chamber. Likewise, as the undesired fluid flows through branch fluid pathway 164, it experiences a greater pressure drop in fluid flow resistor 180, a vortex chamber, than in fluid flow resistor 182, a nozzle. As the total pressure drop across each branch fluid pathway 163, 164 must be the same, due to the common fluid inlets and common fluid outlets, the pressure at pressure output terminals 178, 184 is different. In this case, the pressure at pressure output terminal 178 is greater than the pressure at pressure output terminal 184, thus biasing valve 163 to the closed position shown in FIG. 4B.

Figure 7C:
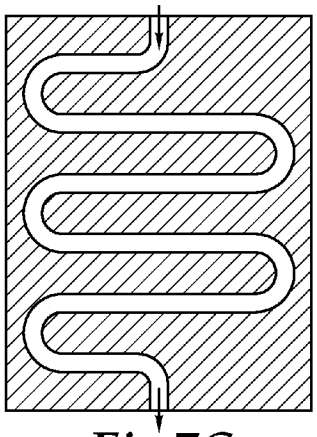
Figure 7D:
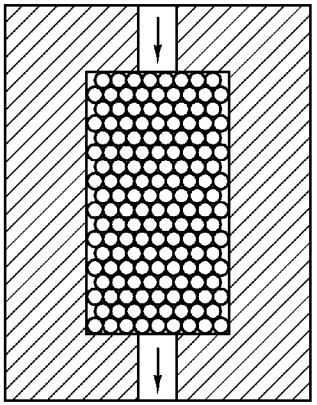
Figure 7E:
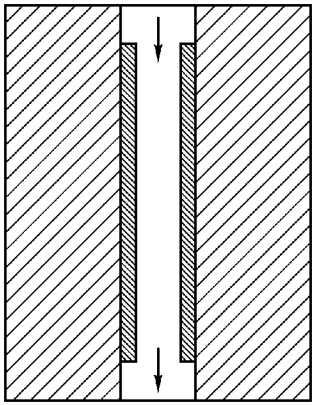
Figure 7F:
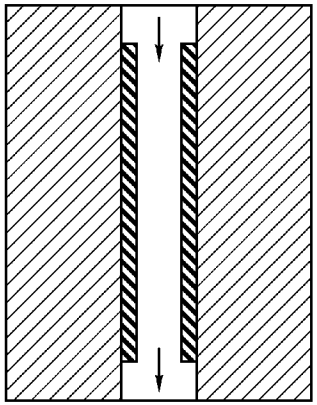

While particular fluid flow resistors have been described as being positioned in fluidic module 150 as fluid flow resistors 174, 176, 180, 182, it is to be clearly understood that other types and combinations of fluid flow resistors may be used to achieve fluid flow control through fluidic module 150. For example, if oil is the desired fluid and water is the undesired fluid, fluid flow resistors 174, 182 may include flow tubes, such as that depicted in FIG. 7C or other tortuous path flow resistors, and fluid flow resistors 176, 178 may be vortex chambers, such as that depicted in FIG. 7B or fluidic diodes having other configurations. In another example, if oil is the desired fluid and gas is the undesired fluid, fluid flow resistors 174, 182 may be matrix chambers, such as that depicted in FIG. 7D wherein a chamber contain beads or other fluid flow resisting filler material, and fluid flow resistors 176, 178 may be vortex chambers, such as that depicted in FIG. 7B. In yet another example, if oil or gas is the desired fluid and water is the undesired fluid, fluid flow resistors 174, 182 may be fluid selectors that include a material that swells when it comes in contact with hydrocarbons, such as that depicted in FIG. 7E, and fluid flow resistors 176, 178 may be fluid selectors that include a material that swells when it comes in contact with water, such as that depicted in FIG. 7F. Alternatively, fluid flow resistors of the present invention could include materials that are swellable in response to other stimulants such as pH, ionic concentration or the like.

Even though FIGS. 4A-4B have been described as having the same types of fluid flow resistors in each branch fluid pathway but in reverse order, it should be understood by those skilled in the art that other configurations of fluid flow resistors that create the desired pressure difference between the pressure output terminals are possible and are considered within the scope of the present invention. Also, even though FIGS. 4A-4B have been described as having two fluid flow resistors in each branch fluid pathway, it should be understood by those skilled in the art that other configurations having more or less than two fluid flow resistors that create the desired pressure difference between the pressure output terminals are possible and are considered within the scope of the present invention.

Figure 5A:
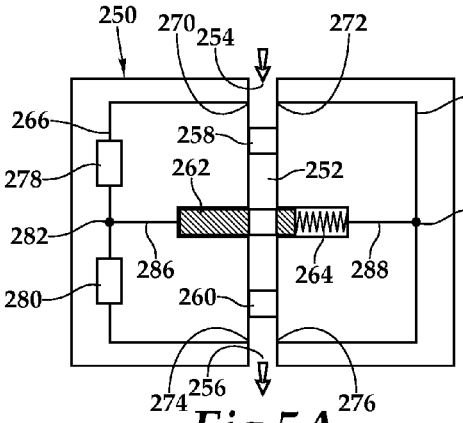
FIGS. 5A-B are schematic illustrations of a fluidic module according to an embodiment of the present invention in first and second operating configurations.
Figure 5B:
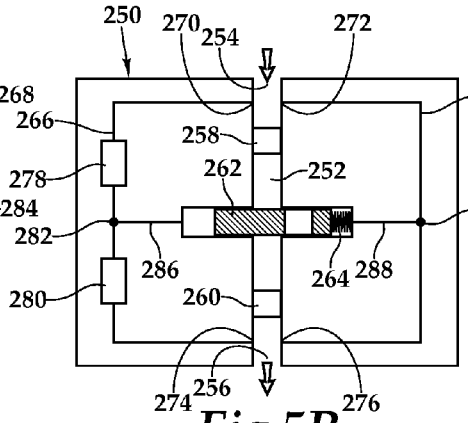

Referring next to FIGS. 5A-5B, therein is depicted a schematic illustration of a fluidic module of the present invention in its open and closed operating positions that is generally designated 250. Fluidic module 250 includes a main fluid pathway 252 having an inlet 254 and an outlet 256. Main fluid pathway 252 provides the primary flow path for fluid transfer through fluidic module 250. In the illustrated embodiment, a pair of fluid flow resistors 258, 260 are positioned within main fluid pathway 252. A valve 262 is positioned relative to main fluid pathway 252 such that valve 262 has a first position wherein fluid flow through main fluid pathway 252 is allowed, as best seen in FIG. 5A, and a second position wherein fluid flow through main fluid pathway 252 is prevented, as best seen in FIG. 5B. In the illustrated embodiment, valve 262 is a pressure operated shuttle valve that is biased to the open position by a spring 264.

Fluidic module 250 includes a bridge network having two branch fluid pathways 266, 268. In the illustrated embodiment, branch fluid pathway 266 has an inlet 270 from main fluid pathway 252. Likewise, branch fluid pathway 268 has an inlet 272 from main fluid pathway 252. Branch fluid pathway 266 has an outlet 274 into main fluid pathway 252. Similarly, branch fluid pathway 268 has an outlet 276 into main fluid pathway 252. Branch fluid pathway 266 has two fluid flow resistors 278, 280 positioned in series with a pressure output terminal 282 positioned therebetween. Branch fluid pathway 268 has a pressure output terminal 284. Pressure from pressure output terminal 282 is routed to valve 262 via fluid pathway 286. Pressure from pressure output terminal 284 is routed to valve 262 via fluid pathway 288. As such, if the combination of the spring force and pressure force generated from pressure output terminal 284 is higher than the pressure force generated from pressure output terminal 282, valve 262 is biased to the open position, as best seen in FIG. 5A. Alternatively, if the pressure force generated from pressure output terminal 282, is higher than the combination of the spring force and pressure force generated from pressure output terminal 284, valve 262 is biased to the closed position, as best seen in FIG. 5B.

The pressure difference between pressure output terminals 282, 284 is created due to differences in flow resistance and associated pressure drops in the fluid flow resistors 278, 280. With this configuration, fluid flow resistors 278, 280 can be selected such that the flow of a desired fluid such as oil through fluidic module 250 generates a differential pressure between pressure output terminals 282, 284 that together with the spring force biases valve 262 to the open position shown in FIG. 5A. Likewise, the flow of an undesired fluid such as water or gas through fluidic module 250 generates a differential pressure between pressure output terminals 282, 284 that is sufficient to overcome the spring force and biases valve 262 to the closed position shown in FIG. 5B.

Figure 6A:
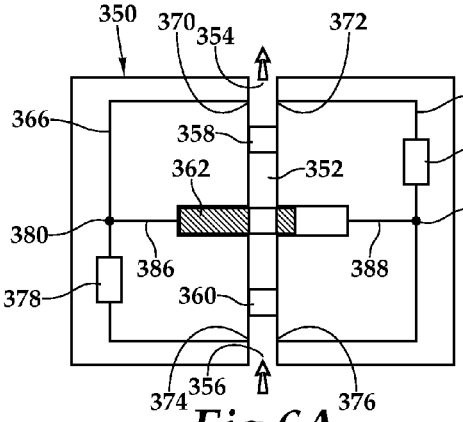
FIGS. 6A-B are schematic illustrations of a fluidic module according to an embodiment of the present invention in first and second operating configurations.
Figure 6B:
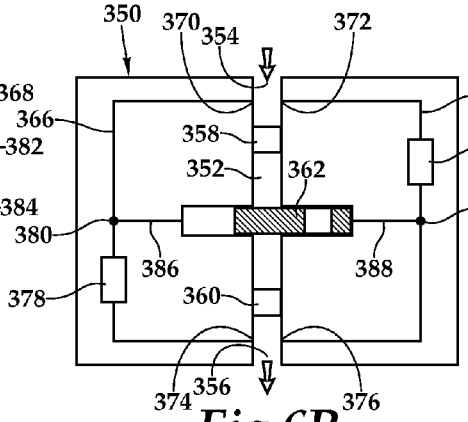

Referring next to FIGS. 6A-6B, therein is depicted a schematic illustration of a fluidic module of the present invention in its open and closed operating positions that is generally designated 350. Fluidic module 350 includes a main fluid pathway 352 has a pair of inlet/outlet ports 354, 356. Main fluid pathway 352 provides the primary flow path for fluid transfer through fluidic module 350. In the illustrated embodiment, a pair of fluid flow resistors 358, 360 are positioned within main fluid pathway 352. A valve 362 is positioned relative to main fluid pathway 352 such that valve 362 has a first position wherein fluid flow through main fluid pathway 352 is allowed, as best seen in FIG. 6A, and a second position wherein fluid flow through main fluid pathway 352 is prevented, as best seen in FIG. 6B. In the illustrated embodiment, valve 362 is a pressure operated shuttle valve.

Fluidic module 350 includes a bridge network having two branch fluid pathways 366, 368. In the illustrated embodiment, branch fluid pathway 366 has a pair of inlet/outlet ports 370, 374 with main fluid pathway 352. Likewise, branch fluid pathway 368 has a pair of inlet/outlet ports 372, 376 with main fluid pathway 352. Branch fluid pathway 366 has a fluid flow resistor 378 and a pressure output terminal 380. Branch fluid pathway 368 has a fluid flow resistor 382 and a pressure output terminal 384. Pressure from pressure output terminal 380 is routed to valve 362 via fluid pathway 386. Pressure from pressure output terminal 384 is routed to valve 362 via fluid pathway 388. As such, if the pressure from pressure output terminal 384 is higher than the pressure from pressure output terminal 380, valve 362 is biased to the open position, as best seen in FIG. 6A. Alternatively, if the pressure from pressure output terminal 380 is higher than the pressure from pressure output terminal 384, valve 362 is biased to the closed position, as best seen in FIG. 6B.

The pressure difference between pressure output terminals 380, 384 is created due to the flow resistance and associated pressure drops created by fluid flow resistors 378, 382. With this configuration, the injection of fluids from the interior of the tubing string into the formation through fluidic module 350 as indicated by the arrows in FIG. 6A generates a differential pressure between pressure output terminals 380, 384 that biases valve 362 to the open position. During production, however, formation fluid flowing into the interior of the tubing string through fluidic module 350 as indicated by the arrows in FIG. 6B generates a differential pressure between pressure output terminals 380, 384 that biases valve 362 to the closed position. In this manner, the flow rate of the injection fluids through fluidic module 350 can be significantly higher than the flow rate of formation fluid during production.

As should be understood by those skilled in the art, the use of a combination of different fluid flow resistors in series on two separate branches of a parallel bridge network enables a pressure differential to be created between selected locations across the bridge network when fluids travel therethrough. The differential pressure may then be used to do work downhole such as shifting a valve as described above.

In addition, while the fluidic modules of the present invention have been described as inflow control devices for production fluids and outflow control devices for injection fluids, it should be understood by those skilled in the art that the fluidic modules of the present invention could alternatively operate as actuators for other downhole tools wherein the force required to actuate the other downhole tools may be significant. In such embodiments, fluid flow through the branch fluid pathways of the fluidic module may be used to shift a valve initially blocking the main fluid pathway of the fluidic module. Once the main fluid pathway is open, fluid flow through the main fluid pathway may be used to perform work on the other downhole tool.

In certain installations, such as long horizontal completions having numerous production intervals, it may be desirable to send a signal to the surface when a particular fluidic module of the present invention has been actuated. If a fluidic module of the present invention is shifted from an open configuration to a closed configuration due to a change in the composition of the production fluid from predominately oil to predominantly water, for example, the actuation of a fluidic module could also trigger a signal that is sent to the surface. In one implementation, the actuation of each fluidic module could trigger the release of a unique tracer material that is carried to the surface with the production fluid. Upon reaching the surface, the tracer material is identified and associated with the fluidic module that triggered its release such that the location of the water breakthrough can be determined.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole fluid flow control system comprising:

a fluidic module having a bridge network with first and second branch fluid pathways each including at least two fluid flow resistors and a pressure output terminal;

wherein the two fluid flow resistors of each branch fluid pathway have different responses to fluid viscosity; and wherein a pressure difference between the pressure output terminals of the first and second branch fluid pathways is operable to control fluid flow through the fluidic module.

2. The flow control system as recited in claim 1 wherein the pressure output terminal of each branch fluid pathway is positioned between the two fluid flow resistors.

3. The flow control system as recited in claim 1 wherein the first and second branch fluid pathways each have a common fluid inlet and a common fluid outlet with a main fluid pathway.

4. The flow control system as recited in claim 3 wherein a fluid flowrate ratio between the main fluid pathway and the branch fluid pathways is between about 5 to 1 and about 20 to 1.

5. The flow control system as recited in claim 3 wherein a fluid flowrate ratio between the main fluid pathway and the branch fluid pathways is greater than 10 to 1.

6. The flow control system as recited in claim 3 wherein the fluidic module further comprises a valve operably positioned in the main fluid pathway and wherein the pressure difference between the pressure output terminals of the first and second branch fluid pathways is operable to shift the valve between first and second positions.

7. The flow control system as recited in claim 6 wherein the fluidic module has an injection mode, wherein the pressure difference between the pressure output terminals of the first and second branch fluid pathways created by an outflow of injection fluid shifts the valve to increase flow through the main fluid pathway, and a production mode, wherein the pressure difference between the pressure output terminals of the first and second branch fluid pathways created by an inflow of production fluid shifts the valve to decrease flow through the main fluid pathway.

8. The flow control system as recited in claim 6 wherein the fluidic module has a first production mode, wherein the pressure difference between the pressure output terminals of the first and second branch fluid pathways created by an inflow of a desired fluid shifts the valve to increase flow through the main fluid pathway, and a second production mode, wherein the pressure difference between the pressure output terminals of the first and second branch fluid pathways created by an inflow of an undesired fluid shifts the valve to decrease flow through the main fluid pathway.

9. The flow control system as recited in claim 1 wherein the fluid flow resistors are selected from the group consisting of nozzles, vortex chambers, flow tubes, fluid selectors and matrix chambers.

10. A flow control screen comprising:

a base pipe with an internal passageway;

a filter medium positioned around the base pipe;

a housing positioned around the base pipe defining a fluid flow path between the filter medium and the internal passageway; and at least one fluidic module disposed within the fluid flow path, the fluidic module having a bridge network with first and second branch fluid pathways each including at least two fluid flow resistors having different responses to fluid viscosity and a pressure output terminal such that a pressure difference between the pressure output terminals of the first and second branch fluid pathways is operable to control fluid flow through the fluidic module.

11. The flow control screen as recited in claim 10 wherein the fluid flow resistors are selected from the group consisting of nozzles, vortex chambers, flow tubes, fluid selectors and matrix chambers.

12. The flow control screen as recited in claim 10 wherein the first and second branch fluid pathways each have a common fluid inlet and a common fluid outlet with a main fluid pathway and wherein the main fluid pathway has a valve disposed therein such that the pressure difference between the pressure output terminals of the first and second branch fluid pathways is operable to shift the valve between first and second positions.

13. The flow control screen as recited in claim 12 wherein the fluidic module has a first production mode, wherein the pressure difference between the pressure output terminals of the first and second branch fluid pathways created by an inflow of a desired fluid shifts the valve to increase flow through the main fluid pathway, and a second production mode, wherein the pressure difference between the pressure output terminals of the first and second branch fluid pathways created by an inflow of an undesired fluid shifts the valve to decrease flow through the main fluid pathway.

14. A downhole fluid flow control method comprising:

positioning a fluid flow control system at a target location downhole, the fluid flow control system including a fluidic module having a bridge network with first and second branch fluid pathways each including at least one fluid flow resistor and a pressure output terminal;

producing a desired fluid through the fluidic module;

responsive to the production of the desired fluid, generating a first pressure difference between the pressure output terminals of the first and second branch fluid pathways that increases flow through the fluidic module;

producing an undesired fluid through the fluidic module; and responsive to the production of the undesired fluid, generating a second pressure difference between the pressure output terminals of the first and second branch fluid pathways that decreases flow through the fluidic module.

15. The method as recited in claim 14 wherein producing a desired fluid through the fluidic module further comprises producing a formation fluid containing at least a predetermined amount of the desired fluid.

16. The method as recited in claim 14 wherein producing an undesired fluid through the fluidic module further comprises producing a formation fluid containing at least a predetermined amount of the undesired fluid.

17. The method as recited in claim 14 wherein generating a first pressure difference between the pressure output terminals of the first and second branch fluid pathways further comprises shifting a valve disposed in a main fluid pathway to a first position and wherein generating a second pressure difference between the pressure output terminals of the first and second branch fluid pathways further comprises shifting the valve to a second position.

18. A downhole fluid flow control system comprising:

a fluidic module having a bridge network with first and second branch fluid pathways each including at least two fluid flow resistors and a pressure output terminal;

wherein the two fluid flow resistors of each branch fluid pathway have different responses to fluid density; and wherein a pressure difference between the pressure output terminals of the first and second branch fluid pathways is operable to control fluid flow through the fluidic module.

19. The flow control system as recited in claim 18 wherein the pressure output terminal of each branch fluid pathway is positioned between the two fluid flow resistors.

20. The flow control system as recited in claim 18 wherein the first and second branch fluid pathways each have a common fluid inlet and a common fluid outlet with a main fluid pathway.

21. The flow control system as recited in claim 20 wherein a fluid flowrate ratio between the main fluid pathway and the branch fluid pathways is between about 5 to 1 and about 20 to 1.

22. The flow control system as recited in claim 20 wherein a fluid flowrate ratio between the main fluid pathway and the branch fluid pathways is greater than 10 to 1.

23. The flow control system as recited in claim 20 wherein the fluidic module further comprises a valve operably positioned in the main fluid pathway and wherein the pressure difference between the pressure output terminals of the first and second branch fluid pathways is operable to shift the valve between first and second positions.

24. The flow control system as recited in claim 23 wherein the fluidic module has an injection mode, wherein the pressure difference between the pressure output terminals of the first and second branch fluid pathways created by an outflow of injection fluid shifts the valve to increase flow through the main fluid pathway, and a production mode, wherein the pressure difference between the pressure output terminals of the first and second branch fluid pathways created by an inflow of production fluid shifts the valve to decrease flow through the main fluid pathway.

25. The flow control system as recited in claim 23 wherein the fluidic module has a first production mode, wherein the pressure difference between the pressure output terminals of the first and second branch fluid pathways created by an inflow of a desired fluid shifts the valve to increase flow through the main fluid pathway, and a second production mode, wherein the pressure difference between the pressure output terminals of the first and second branch fluid pathways created by an inflow of an undesired fluid shifts the valve to decrease flow through the main fluid pathway.

26. The flow control system as recited in claim 18 wherein the fluid flow resistors are selected from the group consisting of nozzles, vortex chambers, flow tubes, fluid selectors and matrix chambers.

27. A flow control screen comprising:

a base pipe with an internal passageway;

a filter medium positioned around the base pipe;

a housing positioned around the base pipe defining a fluid flow path between the filter medium and the internal passageway; and at least one fluidic module disposed within the fluid flow path, the fluidic module having a bridge network with first and second branch fluid pathways each including at least two fluid flow resistors having different responses to fluid density and a pressure output terminal such that a pressure difference between the pressure output terminals of the first and second branch fluid pathways is operable to control fluid flow through the fluidic module.

28. The flow control screen as recited in claim 27 wherein the fluid flow resistors are selected from the group consisting of nozzles, vortex chambers, flow tubes, fluid selectors and matrix chambers.

29. The flow control screen as recited in claim 27 wherein the first and second branch fluid pathways each have a common fluid inlet and a common fluid outlet with a main fluid pathway and wherein the main fluid pathway has a valve disposed therein such that the pressure difference between the pressure output terminals of the first and second branch fluid pathways is operable to shift the valve between first and second positions.

30. The flow control screen as recited in claim 29 wherein the fluidic module has a first production mode, wherein the pressure difference between the pressure output terminals of the first and second branch fluid pathways created by an inflow of a desired fluid shifts the valve to increase flow through the main fluid pathway, and a second production mode, wherein the pressure difference between the pressure output terminals of the first and second branch fluid pathways created by an inflow of an undesired fluid shifts the valve to decrease flow through the main fluid pathway.

* * * * *